United States Patent [19]

Soltau

[11] Patent Number: 4,763,954

[45] Date of Patent: Aug. 16, 1988

[54] EXCAVATOR AND CONVEYOR OF AN UNDERGROUND PIPELINE JACKING APPARATUS

[76] Inventor: Gerd Soltau, Artlenburger Landstr. 15, 2120 Luneburg, Fed. Rep. of Germany

[21] Appl. No.: 21,080

[22] Filed: Mar. 3, 1987

[30] Foreign Application Priority Data

Mar. 7, 1986 [DE] Fed. Rep. of Germany ..... 3607461
Jan. 23, 1987 [DE] Fed. Rep. of Germany ..... 3701851

[51] Int. Cl.[4] ..... E21B 7/20

[52] U.S. Cl. ..... 299/56; 299/64; 198/670

[58] Field of Search ..... 299/55, 56, 57, 58, 299/87, 64; 198/670, 671; 414/292, 326, 519, 520; 222/412, 457; 251/1.2, 61.1; 166/88

[56] References Cited

U.S. PATENT DOCUMENTS

| | | | |
|---|---|---|---|
| 2,634,114 | 4/1953 | Joy | 299/87 X |
| 3,333,679 | 8/1967 | Zimmerman et al. | 198/670 X |
| 4,071,085 | 1/1978 | Grable et al. | 166/88 X |
| 4,275,926 | 6/1981 | Hodges | 299/87 X |
| 4,456,305 | 6/1984 | Yoshikawa | 299/56 X |
| 4,482,045 | 11/1984 | Voss | 198/670 |

*Primary Examiner*—Jerome Massie, IV

*Assistant Examiner*—Matthew Smith

*Attorney, Agent, or Firm*—Edwin E. Greigg

[57] ABSTRACT

The invention relates to an excavator and conveyor for an underground jacking apparatus for pipelines having a preferably non-man-sized rated cross section, which is driven into the surrounding soil from a manhole and comprises a digging head and at least one follower, jacking the digging head, and thereafter introducing additional jacked lengths of pipe. Rotating in the end area of the digging head is a digging disc which is set into rotation by a shaft. The shaft is surrounded at a distance by a conveyor tube, the wall of which is compartmentalized with respect to its outer cylindrical jacket in the vicinity of the digging head. Conveyor means are provided in the conveyor tube for conveying the excavated material back to the manhole. Sluice means are also provided in the conveyor cross section between the shaft and the conveyor tube wall, these sluice means serving to prevent incursions of groundwater. The sluice means comprise at least one annular bellows that can be expanded by means of a flowable medium; the shaft extends all the way through the bellows, and the conveyor cross section is closed completely or partially by the bellows depending on the required compartmentalization and on the extent of expansion.

21 Claims, 3 Drawing Sheets

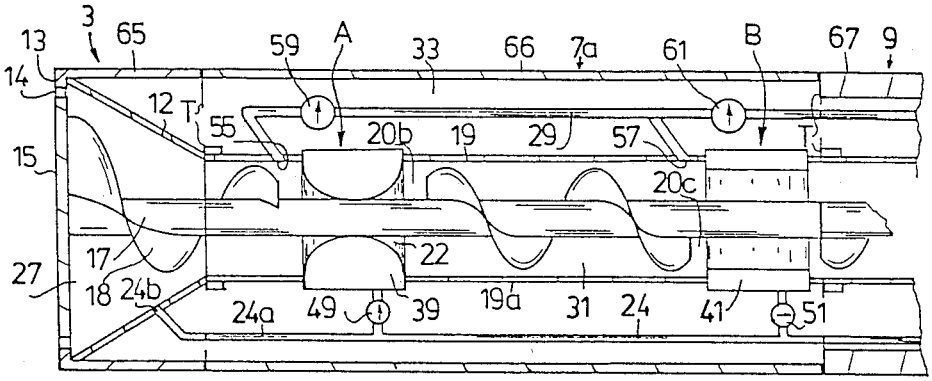
I II III Fig.5
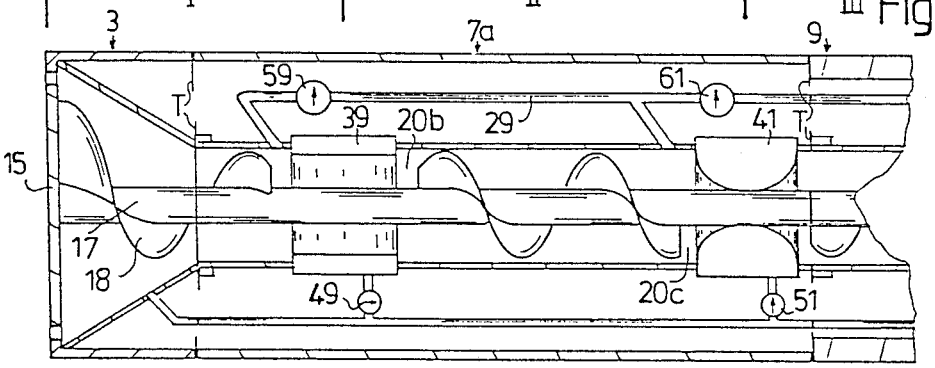
I II III Fig.6
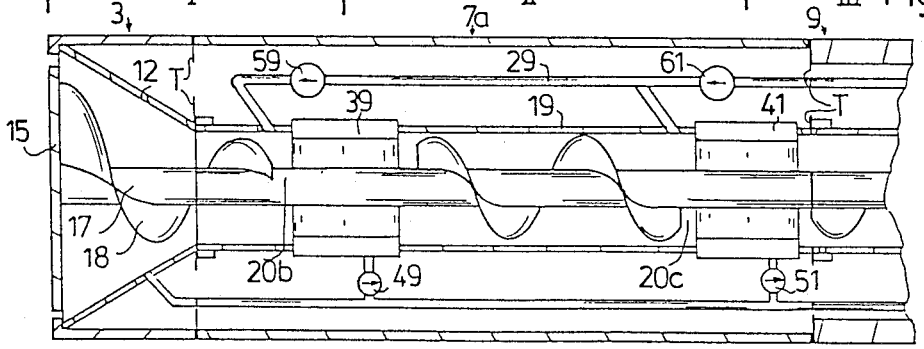
Fig.7

EXCAVATOR AND CONVEYOR OF AN UNDERGROUND PIPELINE JACKING APPARATUS

BACKGROUND OF THE INVENTION

The invention relates to an excavator and conveyor for an underground jacking apparatus for pipelines having a preferably non-man-sized rated cross section, which is driven into the surrounding soil from a manhole and comprises a digging head and at least one follower; means being provided for jacking the digging head, and introducing other jacked lengths of pipe as soil is removed. Rotating in the end area of the digging head is a digging disc which is set into rotation by a shaft. The shaft is surrounded at a distance by a conveyor tube, the wall of which is compartmentalized with respect to its outer cylindrical jacket in the vicinity of the digging head. Conveyor means are provided in the conveyor tube for conveying the excavated material back to the manhole. Sluice means are also provided in the conveyor cross section between the shaft and the conveyor tube wall, which serve to prevent incursions of groundwater.

A sluice means of this kind is known from German Offenlegungsschrift DE-OS No. 32 28 684. The sluice means comprises a diaphragm, firmly fastened at its periphery to the conveyor tube wall, by means of which compartmentalization to prevent groundwater incursions is to be attained. The service life of such a diaphragm is limited, however. The diaphragm is used in a conveyor that is part of an apparatus for jacking product pipes or lengths of product pipe, the pipes having non-man-sized rated cross sections. The jacking of the pipelines is done with the aid of the jacking apparatus, from a manhole sunk into the soil. From the manhole, a shaft is extended outward through the conveyor tube as far as a digging head; this shaft turns a digging disc inside the digging head for the removal of soil from the area. The excavated soil is conveyed backward to the manhole by the conveyor screw surrounding the shaft. From the manhole, the soil is carried to the surface and removed from the site. To prevent the excavated soil from getting in between an outer cylindrical jacket of the digging head and the following jacked product tubes, on the one hand, and between this jacket and the smaller-diameter conveyor tube, on the other, the outer cylindrical jacket of the digging head is compartmentalized with respect to the conveyor tube by means of a frustoconical driving shield.

When the existing soil contains a varying amount of groundwater from one time to another, then its flowability varies as well. Until now, compartmentalization was done by making it substantially completely watertight, either by means of the diaphragm according to German Offenlegungsschrift 32 28 684, or by means of a plain plug of material or soil as described in German Patent No. 35 13 578.

OBJECT AND SUMMARY OF THE INVENTION

The object of the invention is to devise an apparatus of the aforementioned type with which compartmentalization can be done in an apportioned manner as needed, over a range from partial compartmentalization to complete compartmentalization.

This object is attained according to the invention in that the sluice means comprise at least one annular bellows that can be expanded by a flowable medium, the shaft extending all the way through the annular bellows, and with which the conveyor cross section can be closed off completely or partially depending on the extent of compartmentalization needed and on the extent of expansion of the bellows.

An adjustable groundwater sluice is thereby provided, with the aid of the adjustable flow cross section, it is possible with increasing water pressure to reduce the flow cross section and hence the total amount of water and soil admitted, and thus to diminish the soil erosion of the driving shield, up to the point of total compartmentalization. If the water pressure is less, then work can be done with a larger flow cross section; the pressure counteracting the groundwater can in other words be less, so as to prevent soil erosion in front of the driving shield. If the proportion of water is less, more soil can be conveyed, and the operating speed of the jacking apparatus can accordingly be improved. With the aid of the expansible annular bellows, the operating speed can thus be optimally adjusted to conditions, in particular to the groundwater conditions, prevailing at the site.

According to another feature of the invention, two annular bellows are provided, spaced apart from one another. With two annular bellows spaced apart from one another, the compartmentalization effect can be increased when there is a large amount of groundwater and high pressure.

According to still another feature of the invention, in order to embody a compartmentalization means the annular bellows are periodically expansible and recontractable in opposite directions to form a sluice. By the periodic contraction and expansion of the annular bellows in opposite directions, intermittent sluice operation can be introduced, and the compartmentalization becomes better and better, the more annular bellows, spaced apart from one another, are provided, in accordance with another feature of the invention. For instance, if two annular bellows, are used, then whenever one annular bellows brings about compartmentalization in its working region, the other annular bellows stops providing compartmentalization. In the space between the two annular bellows, the excavated soil and water can be accumulated in one operation and then removed in the next. One annular bellows at a time provides total compartmentalization.

Conveying the excavated material to the rear can be done, in accordance with another feature of the invention, by providing that a conveyor screw on the shaft, and the working region of the annular bellows is kept free of conveyor screw parts. A simple and suitable kind of conveying is thus combined with a groundwater sluice having a regulatable cross section.

The annular hellows can act either from the inside outward or from the outside in. According to an advantageous embodiment of the invention, however, the one or more annular bellows are disposed on the conveyor tube wall and are expansible inward from there. This facilitates connection of the flowable medium.

In another feature of the invention, the flowable medium is compressed air or a liquid. In yet another feature of the invention, the liquid is above all an incompressible liquid, such as a hydraulic fluid. With an incompressible liquid, finer regulation or apportioning of the amount of flowable medium in the annular bellows is attainable if needed.

Another feature of the invention provides that the inflow of flowable medium to the annular bellows is regulatable by means of sluice valves in lines supplying the medium. Such sluice valves may be both pressure-regulating and flow-regulating valves, which are remote-controlled from the manhole or from a station on the surface.

In another feature of the inveniton, when compressed air is used as the flowable medium, this air can, in addition to the especially regulated supply to the annular bellows, be forced continuously into the digging area of the digging head in front of the driving shield. Compressed air used as the medium has the advantage of a dual action, because it is effective both in the annular bellows and in the vicinity of the digging area. By continuously forcing compressed air into the digging area of the digging head, a retaining pressure, known per se, is already exerted upon the existing water.

According to still another feature of the invention, a flushing line is provided, by means of which the flushing water can be injected into the working regions of the annular hellows, preferably upstream of these working regions as viewed in the jacking direction. If stoppage should occur during the conveying of excavated soil to the rear, the forced-in flushing water overcomes it.

According to another feature of the invention, the spacing between two working regions of the annular bellows is approximately equivalent to the axial length of two screw courses on the shaft. This kind of spacing of the working regions has proved to be suitable for problem-free operation.

In another feature of the invention, the annular hellows are of flexible, highly tough plastic, such as "Pur-Zell" or "Zell-Vulcolanschaum". This kind of material has proved to be extraordinarily well suited for the rough conditions involved in underground jacking of pipes having non-man-sized pipe cross sections.

The invention will be better understood and further objects and advantages thereof wil become more apparent from the ensuing detailed description of a preferred embodiment taken in conjunction with the drawings.

BRIEF DESCRIPTION OF THE DRAWINGS

FIGS. 5–7 show an apparatus having two counter-phase-operated annular-bellows-like groundwater sluices in phase operation.

DESCRIPTION OF THE PREFERRED EMBODIMENT

Figure 1:
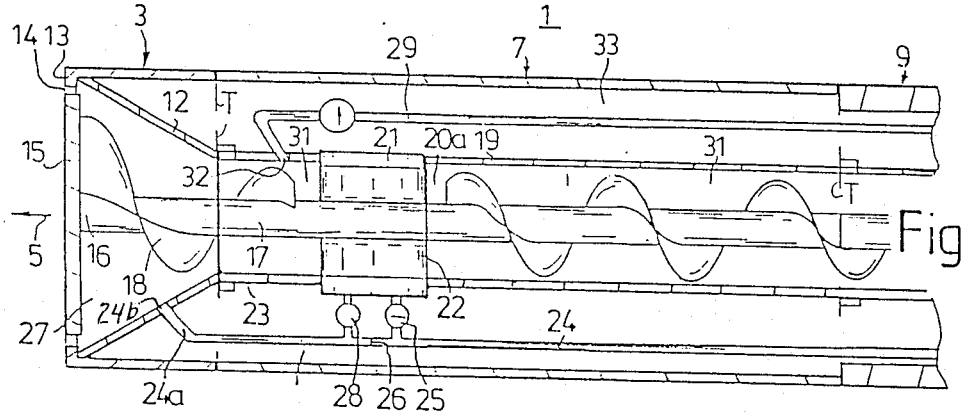
FIGS. 1–3 show the digging part of an apparatus for underground jacking of pipelines having an annular-bellows-like groundwater sluice in the fully open, half-open and closed positions, respectively, seen partly in section.
Figure 4:
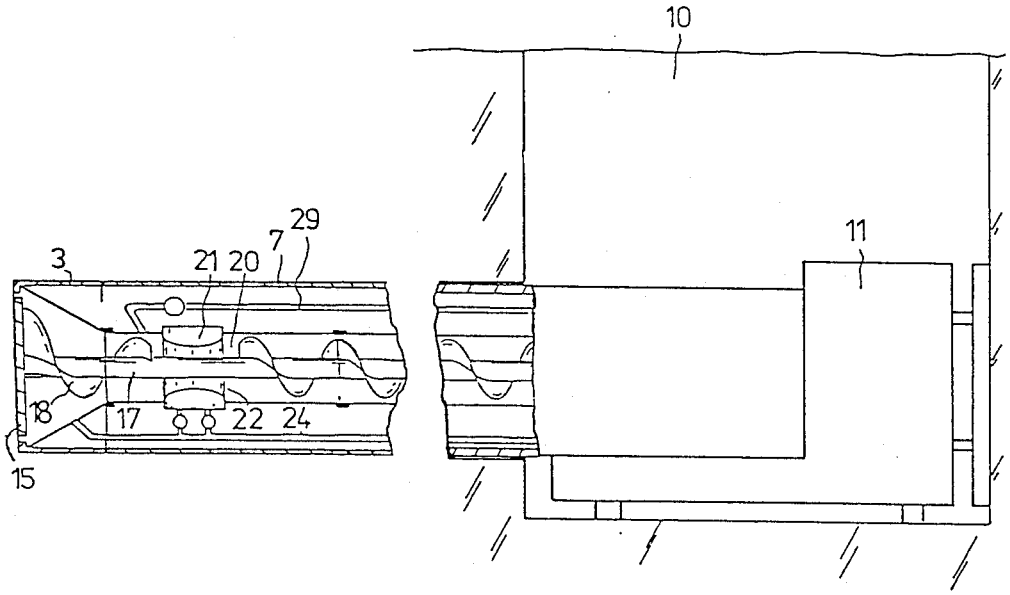
FIG. 4 shows an apparatus according to FIG. 1 having one annular bellows as the groundwater sluice, in which jacking proceeds from a manhole.

The excavator part 1, shown in FIG. 1, of an apparatus for underground jacking of pipelines comprises a digging or control head 3 and a follower 7, which comes after the digging head in the jacking direction, which is indicated by the arrow 5. After the follower 7 in turn come lengths of pipe 9, which are jacked in succession, following the follower 7 and the digging head 3, from the manhole 10 (see FIG. 4) by a jacking apparatus 11. This jacking operation, effected by driving forward individual lengths of pipe 9 following one another, and the followers 7 and digging heads 3 that precede them, is known, as is the possibility of controlling the digging or control head 3 preceding the follower 7 in the jacking direction. Accordingly, the pressure faces resting against one another of the various pipe parts and the control apparatus for the digging or control head 3 will not be described in detail here.

Inside the digging head 3 is a frustoconically spread-apart driving shield 12. This driving shield ends at the face 13 of the digging head 3, which has an opening 14 toward the front in which a digging disc 15 can rotate. This digging disc 15 is disposed on the front end 16 of a shaft 17, which is set to rotating by the jacking apparatus 11 in the manhole 10. A conveyor screw 18 is disposed on the shaft 17, with which the soil excavated by the digging disc 15 is conveyed to the rear to the manhole 10.

The shaft 17, along with the conveyor screw 18 disposed on it, rotates in a conveyor tube 19. As a result, the excavated soil can be reliably carried to the manhole 10 inside the lengths of pipe 9 and follower 7. The shaft 17, along with the conveyor screw 18 and conveyor tube 19, is divided up into portions that can be combined together, and the length of the portions corresponds to the length of the pipe lengths. The divisions are indicated by dashes marked T, and their construction is known.

The conveyor screw 18 has an interruption region 20*a* inside the follower 7. A tuhular bellows 21 which acts as a groundwater sluice is disposed on the wall of the conveyor tube, inside the interruption region 20*a*. The annular bellows 21 comprises a flexible, highly tough plastic, in particular an expanded plastic. The annular bellows 21 is embodied such that by introducing a flowable medium it can be expanded inward, specifically into the cross section 22 of the conveyor tube 19 in the direction toward the shaft 17. It would also be conceivable, however, if necessary or desirable, to secure the annular bellows 21 to the shaft 17 and expand it outward in the direction of the wall of the conveyor tube 19. In both cases, the annular bellows 21 acts as a sluice element, with the aid of which the flow cross section of the tube 19 can be varied.

The expansion of the annular bellows 21 can be accomplished with either compressed air or a liquid. As the flowable liquid medium, an incompressible liquid, in particular hydraulic fluid, is preferably used.

The interruption region 20*a* for the annular bellows 21 must he provided in the vicinity of the end 23 of the conveyor tube toward the digging head. Its distance from the digging disc should be 1.0 meters but for constructional reasons it may also disposed farther to the rear.

The flowable medium is delivered from the manhole 10 via a pipeline 24. If the medium is a hydraulic fluid, then the pipe 24 is closed downstream of a flow rate measuring valve 25, at a point marked 26. If the expansion medium is air, however, then the tube 24 is extended farther with a pipe section 24*a*, until finally it discharges in the digging space 27 in front of the driving shield 12. In a branch leading away from the pipe region 24*a* and leading to the annular bellows 21 there is a pressure regulating valve 28, with which the pressure inside the annular bellows 21 can be adjusted. Under some conditions, it may be sufficient to arrange only one of the valves 25 and 28 to act as sluice valves. Through an outlet opening 24*b* at the end of the pipe section 24*a*, the digging space 27 is additionally acted upon by compressed air, which prevents or reduces soil erosion in front of the digging disc 15.

To assure that lasting stoppages will not occur in the interruption region 20*a*, a flushing water line 29 is provided, which discharges into the interior 31 of the conveyor tube 19, preferably upstream of but in the vicinity of the interruption region 20*a*. The injection direction via the opening 32 is located obliquely to the rear, so that the flushing water is injected directly into the region upstream of the annular bellows 21.

Figure 2:
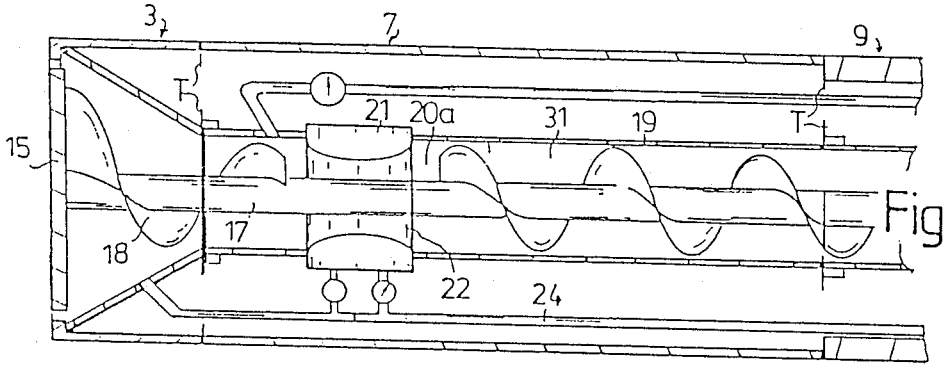
Figure 3:
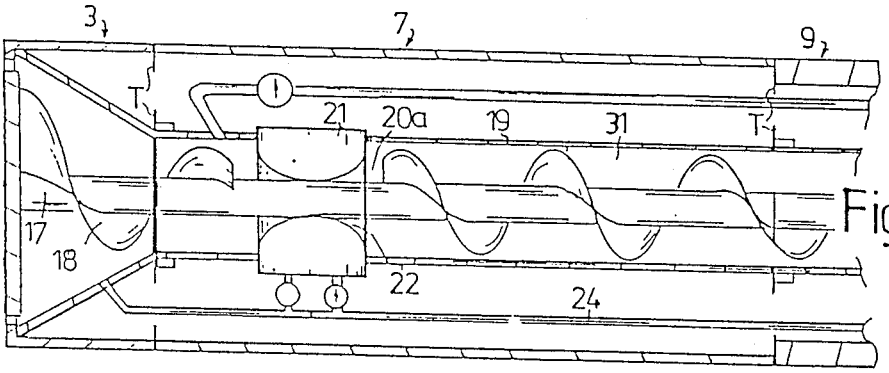

The sluice element in the form of the annular bellows 21 should be capable of closing the cross section 22 in the interior 31 of the conveyor tube 19 to the desired extent, to provide an adaptation to the flowability of the soil being excavated. If the soil excavated has a relatively high proportion of groundwater, then its flowability is greater than if there is a lower proportion of groundwater. It is also variably difficult to move the soil, depending on its composition. For optimal adaptation in this respect and hence to attain optimal jacking speeds, the annular bellows is inflatable, and FIG. 2 shows the annular bellows 21 closing off half, for example, of the cross section 22 of the interior 31 of the conveyor tube 19. FIG. 3 shows how the annular bellows 21 is expanded such that it is in contact with the shaft 17. This represents a complete closure of the cross section 22, for instance during lulls in operation or when groundwater suddenly breaks in. The service life of an annular bellows of this kind, made of flexible, tough and high-strength plastic, is adequate for all needs that arise in conduit or sewer construction, especially with rated pipeline cross sections that are not man-sized.

FIG. 5 shows another embodiment of an excavator and conveyor having the control head 3 and the follower 7*a*. The control head 3 and the follower 7*a* are once again jacked into the existing soil from the manhole 10, with the aid of the following pipe lengths 9, by means of the jacking apparatus 11 (see FIG. 4). The cylindrical outer wall 65 of the control head 3 has a diameter that corresponds to that of the outer wall 66 of the follower 7*a* and the outer wall 67 of the following pipe lengths 9. The conveyor tube 19, in which the shaft 17 that carries the conveyor screw 18 rotates, is located inside the follower 7*a*.

The shaft 17 drives the digging disc 15 in the vicinity of the face 13 of the control head 3. The conveyor tube 19 discharges inside the control head 3 into the frustoconically widened driving shield 12.

The conveyor screw 18 has interruption regions 20*b* and 20*c* inside the follower 7. In the wall 19*a* of the conveyor tube 19, annular bellows 39, 41 are provided in the interruption regions 20*b* and 20*c*. These annular hellows 39, 41 again comprise a flexible, highly tough plastic, for example an expanded plastic. The annular bellows 39, 41 are embodied such that when compressed air is blown in they are expansible in such a manner into the interior 31 of the conveyor tube 19 that they wrap around the shaft 17 from the outside. However, they can also be contracted back against the wall 19*a* of the conveyor tube 19 from this compartmentalizing state, so that soil being moved can be conveyed on past them. The annular bellows 39 and 41 are supplied with compressed air via the line 24, which discharges via an opening 24*b* into the digging space 27 in front of the driving shield 12. Opening/closing sluice valves 49 and 51 are provided, by means of which the compressed air can be introduced into the two annular bellows 39 and 41. The opening/closing sluice valves 49 and 51 have an air outlet position, not shown, by way of which the compressed air can be blown out of the annular bellows into the hollow space 33 between the outer wall of the outer follower 7*a* and the conveyor tube 19.

A flushing water line 29 is also provided, by means of which the flushing water can be injected into the interruption regions 20*b*, 20*c* via orifices 55 and 57. Opening/closing valves 59 and 61 are disposed in the flushing water line 29. The tube orifices 55 and 57 are held such that inflowing flushing water is injected into the interruption regions 20*b*, 20*c* in such a way that it loosens backed-up soil and drives it forward toward the manhole 10. The outlets 55 and 57 are preferably located upstream, as viewed in the jacking direction, of the interruption regions 20*b* and 20*c*.

Three conveyor spaces I, II, and III can be distinguished in the longitudinal direction of the screw conveyor apparatus. The conveyor space I is located upstream in the jacking direction of the first sluice A, embodied by the annular bellows 39. The conveyor space II then follows, between the sluices A and B; the sluice B can be embodied by the annular bellows 41. The conveyor space III is located downstream, in the jacking direction, of the sluice B and leads to the manhole 10.

FIG. 5 shows a conveying situation in which the sluice A is closed by the inflation of the annular bellows 39. The flushing water valves 59 and 61 are closed as well. The sluice valve 49 is opened, and the sluice valve 51 is closed. The compressed air flows not only into the annular hellows 39 but also through the driving shield 12. The sluice B is open. If the shaft 17 is now turned, then the digging disc 15 moves excavated soil into the space I up to the upstream end of the sluice A. Soil that was located in the conveyor spaces I and II is carried away by the conveyor screw 18 to the manhole 10.

Once the conveyor space II is evacuated, then by closing the sluice valve 49 the air is evacuated from the annular bellows 39 into the space 33, and the annular bellows retracts toward the wall of the conveyor tube 19. At the same time, the sluice valve 51 is opened. The annular bellows 41 has thus been expanded, and it now firmly encloses the shaft 17. In this operating state shown in FIG. 6, the digging disc 15 moves excavated soil past the sluice A as far as the sluice B. The conveyor space II thereby fills up. Excavated soil is carried out of the conveyor space III on toward the manhole 10.

Once the conveyor space II has filled, then the sluice B is closed again, while the sluice A opens. By means of this counterphase opening and closing, a periodic filling and evacuation of the conveyor space II takes place. This counterphase opening and closing can be automatically controlled in accordance with a fixedly predetermined phase; it is also possible, however, for the phase length to be determined individually by special sensors in accordance with the filling speed, and to indroduce partially closed intermediate positions.

It has proved to be suitable for the distance between two screw interruptions 20*b*, 20*c* or two sluices A, B to be dimensioned in terms of axial length approximately to the length of two screw courses. It is readily possible to add still other sluices, for example to provide still more thorough sealing.

FIG. 7 shows a situation where the excavated soil may have plugged the interruption regions 20*b* and 20*c*. In this case, the flushing water valves 59 and 61 are opened when the sluices A, B are opened, so that the flushing water can be injected into the interruption regions 20b, 20c counter to the conveying direction, until the solidified soil is loosened hy flooding and can then be moved on in the direction of the manhole 10.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An excavator and conveyor for an underground jacking apparatus for pipelines having a perferably non-man-sized rated cross section, which is driven into the surrounding soil from a manhole comprising a digging head, provided with a rotatable digging disc means, follower means having a same diametrical dimension as said digging head and arranged to advance with digging head axially disposed linear shaft provide within said digging head, said shaft rotatably arranged within a conveyor tube and including a screw conveyor along its length, said conveyor tube being coaxial with said follower means and having a cylindrical wall radially spaced from said follower means, at least one sluice means associated with said conveyor tube disposed in an interrupted zone of said conveyor screw, said at least one sluice means including an annular expansible bellows operative within said conveyor tube, and means to introduce a flowable medium into said bellows whereby soil passage through the conveyor tube cross section may be closed gradually and to the extent desired.

2. An excavator and conveyor as defined by claim 1, in which at least two annular bellows are arranged in spaced relation in interrupted zones on said shaft.

3. An excavator and conveyor as defined by claim 2, in which said annular bellows are periodically expansible and contractible in opposite direction thereby adapting said sluice means for compartmentalization within said conveyor tube.

4. An excavator and conveyor as defined by claim 1, in which the shaft and said screw conveyor means further includes separately axially arranged sections provided with interrupted zones.

5. An excavator and conveyor as defined by claim 2, in which the shaft and said screw conveyor means further includes separately axially arranged sections provided with interrupted zones.

6. An excavator and conveyor as defined by claim 1, in which said at least one annular bellows is disposed on said conveyor tube wall.

7. An excavator and conveyor as defined by claim 2, in which each of said annular bellows are disposed on said conveyor tube wall.

8. An excavator and conveyor as defined by claim 1, in which said flowable medium is compressed air.

9. An excavator and conveyor as defined by claim 2, in which said flowable medium is compressed air.

10. An excavator and conveyor as defined by claim 1, in which said flowable medium is a liquid.

11. An excavator and conveyor as defined by claim 2, in which said flowable medium is a liquid.

12. An excavator and conveyor as defined by claim 1, in which said flowable medium is an incompressible liquid.

13. An excavator and conveyor as defined by claim 1, in which flow of said flowable medium to said annular bellows is controlled by means of sluice valves provided in lines which supply said medium.

14. An excavator and conveyor as defined by claim 2, in which flow of said flowable medium to each of said annular bellows is controlled by means of sluice valves provided in lines which supply said medium.

15. An excavator and conveyor as defined by claim 6, in which said flowable medium is continuously introduced into a driving shield associated with said conveyor tube.

16. An excavator and conveyor as defined by claim 1, in which a flushing line is associated with said conveyor tube upstream of said bellows whereby flushing water is injected to a working region of said screw conveyor.

17. An excavator and conveyor as defined by claim 2, in which said annular bellows are spaced apart a distance which is approximately equivalent to the axial length of two screw courses on said shaft.

18. An excavator and conveyor as defined by claim 1, in which said annular bellows comprises a flexible, highly tough plastic preferably flexible, highly tough expanded plastic.

19. An excavator and conveyor as defined by claim 1, in which said annular bellows comprises a flexible highly tough expanded plastic.

20. A excavator and conveyor as defined by claim 1 in which said digging head and said follower means have a diametrical dimension which is the same as the outer diameter of a pipe to be introduced into the excavation.

21. An excavator and conveyor as defined by claim 12 in whcih said incompressible liquid is a hydraulic fluid.

* * * * *